US006547635B1

(12) United States Patent
Gildea

(10) Patent No.: US 6,547,635 B1
(45) Date of Patent: Apr. 15, 2003

(54) DOLL BATH

(76) Inventor: Edward J. Gildea, 10 Summit St., Peabody, MA (US) 01960

( * ) Notice: Subject to any disclaimer, the term of this patent is extended or adjusted under 35 U.S.C. 154(b) by 0 days.

(21) Appl. No.: 09/822,517

(22) Filed: Mar. 30, 2001

(51) Int. Cl.[7] ..... A63H 3/52; A47K 3/02
(52) U.S. Cl. ..... 446/479; 4/538
(58) Field of Search ..... 446/267, 296, 446/479, 481, 482, 472; 4/538, 584, 592

(56) References Cited

U.S. PATENT DOCUMENTS 1,729,258 A * 9/1929 Hostetter ..... 4/546
1,979,596 A * 11/1934 Woolfolk ..... 4/584
2,045,867 A * 6/1936 Mueller ..... 4/584
2,269,748 A * 1/1942 Widman ..... 4/584
3,557,390 A * 1/1971 Ruggles ..... 4/568
3,614,952 A * 10/1971 Agnellino ..... 4/584
3,827,086 A * 8/1974 Seymour et al. ..... 4/584
3,969,776 A * 7/1976 Gildea ..... 4/546
4,080,710 A * 3/1978 Hess ..... 264/157
4,357,721 A * 11/1982 Newburger ..... 4/538
4,578,832 A * 4/1986 Primucci ..... 4/584
5,181,284 A * 1/1993 Raphael et al. ..... 4/572.1
5,276,926 A * 1/1994 Lopez ..... 4/568
5,333,325 A * 8/1994 Levien et al. ..... 4/546
5,778,463 A * 7/1998 Teckchandani et al. ..... 4/538
5,940,906 A * 8/1999 Halloran ..... 4/584

* cited by examiner

*Primary Examiner*—Jacob K. Ackun
*Assistant Examiner*—Faye Francis

(57) ABSTRACT

A doll bath for bathing dolls and the like. The doll bath includes a housing having a top wall, a first side wall, a second side wall, a third side wall, and a fourth side wall. The first and second side walls is opposite of each other. The top wall has an opening therein. A toy bathtub is positioned in the opening and has a size substantially equal to the opening. An upper edge of the bathtub has a lip thereon coupled to the top wall. A pipe is elongated and has a first end and a second end. The pipe has a pair of bends therein each generally equal to 90 degrees. Each of the bends is located generally adjacent to one of the ends of the pipe such that the ends are directed in opposite directions of each other. The pipe is positioned in the first side wall and extends upwardly from the top wall such that the first end of the pipe is directed toward the bath tub and the second end of the pipe extends through the back side of the first side wall. The first end of the pipe has a nozzle thereon. The second end of the pipe has a threaded hose coupler thereon.

1 Claim, 2 Drawing Sheets

DOLL BATH

BACKGROUND OF THE INVENTION

1. Field of the Invention

The present invention relates to toy bathtubs and more particularly pertains to a new doll bath for bathing dolls and the like.

2. Description of the Prior Art

The use of toy bathtubs is known in the prior art. More specifically, toy bathtubs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,568,302; U.S. Pat. No. 3,842,531; U.S. Pat. No. 3,998,001; U.S. Pat. No. 5,181,284; U.S. Pat. No. 4,561,134; and U.S. Des. Pat. No. 350,598.

While these devices fulfill their respective, particular objectives and requirements, the aforementioned patents do not disclose a new doll bath. The inventive device includes a housing having a top wall, a first side wall, a second side wall, a third side wall, and a fourth side wall. The first and second side walls is opposite of each other. The top wall has an opening therein. A toy bathtub is positioned in the opening and has a size substantially equal to the opening. An upper edge of the bathtub has a lip thereon coupled to the top wall. A pipe is elongated and has a first end and a second end. The pipe has a pair of bends therein each generally equal to 90 degrees. Each of the bends is located generally adjacent to one of the ends of the pipe such that the ends are directed in opposite directions of each other. The pipe is positioned in the first side wall and extends upwardly from the top wall such that the first end of the pipe is directed toward the bath tub and the second end of the pipe extends through the back side of the first side wall. The first end of the pipe has a nozzle thereon. The second end of the pipe has a threaded hose coupler thereon.

In these respects, the doll bath according to the present invention substantially departs from the conventional concepts and designs of the prior art, and in so doing provides an apparatus primarily developed for the purpose of bathing dolls and the like.

SUMMARY OF THE INVENTION

In view of the foregoing disadvantages inherent in the known types of toy bathtubs now present in the prior art, the present invention provides a new doll bath construction wherein the same can be utilized for bathing dolls and the like.

The general purpose of the present invention, which will be described subsequently in greater detail, is to provide a new doll bath apparatus and method which has many of the advantages of the toy bathtubs mentioned heretofore and many novel features that result in a new doll bath which is not anticipated, rendered obvious, suggested, or even implied by any of the prior art toy bathtubs, either alone or in any combination thereof.

To attain this, the present invention generally comprises a housing having a top wall, a first side wall, a second side wall, a third side wall, and a fourth side wall. The first and second side walls is opposite of each other. The top wall has an opening therein. A toy bathtub is positioned in the opening and has a size substantially equal to the opening. An upper edge of the bathtub has a lip thereon coupled to the top wall. A pipe is elongated and has a first end and a second end. The pipe has a pair of bends therein each generally equal to 90 degrees. Each of the bends is located generally adjacent to one of the ends of the pipe such that the ends are directed in opposite directions of each other. The pipe is positioned in the first side wall and extends upwardly from the top wall such that the first end of the pipe is directed toward the bath tub and the second end of the pipe extends through the back side of the first side wall. The first end of the pipe has a nozzle thereon. The second end of the pipe has a threaded hose coupler thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new doll bath apparatus and method which has many of the advantages of the toy bathtubs mentioned heretofore and many novel features that result in a new doll bath which is not anticipated, rendered obvious, suggested, or even implied by any of the prior art toy bathtubs, either alone or in any combination thereof.

It is another object of the present invention to provide a new doll bath which may be easily and efficiently manufactured and marketed.

It is a further object of the present invention to provide a new doll bath which is of a durable and reliable construction.

An even further object of the present invention is to provide a new doll bath which is susceptible of a low cost of manufacture with regard to both materials and labor, and which accordingly is then susceptible of low prices of sale to the consuming public, thereby making such doll bath economically available to the buying public.

Still yet another object of the present invention is to provide a new doll bath which provides in the apparatuses and methods of the prior art some of the advantages thereof, while simultaneously overcoming some of the disadvantages normally associated therewith.

Still another object of the present invention is to provide a new doll bath for bathing dolls and the like.

Yet another object of the present invention is to provide a new doll bath which includes a housing having a top wall, a first side wall, a second side wall, a third side wall, and a fourth side wall. The first and second side walls is opposite of each other. The top wall has an opening therein. A toy bathtub is positioned in the opening and has a size substantially equal to the opening. An upper edge of the bathtub has a lip thereon coupled to the top wall. A pipe is elongated and has a first end and a second end. The pipe has a pair of bends therein each generally equal to 90 degrees. Each of the bends is located generally adjacent to one of the ends of the pipe such that the ends are directed in opposite directions of each other. The pipe is positioned in the first side wall and extends upwardly from the top wall such that the first end of the pipe is directed toward the bath tub and the second end of the pipe extends through the back side of the first side wall. The first end of the pipe has a nozzle thereon. The second end of the pipe has a threaded hose coupler thereon.

Still yet another object of the present invention is to provide a new doll bath that allows a child to wash their dolls in a play environment with running water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
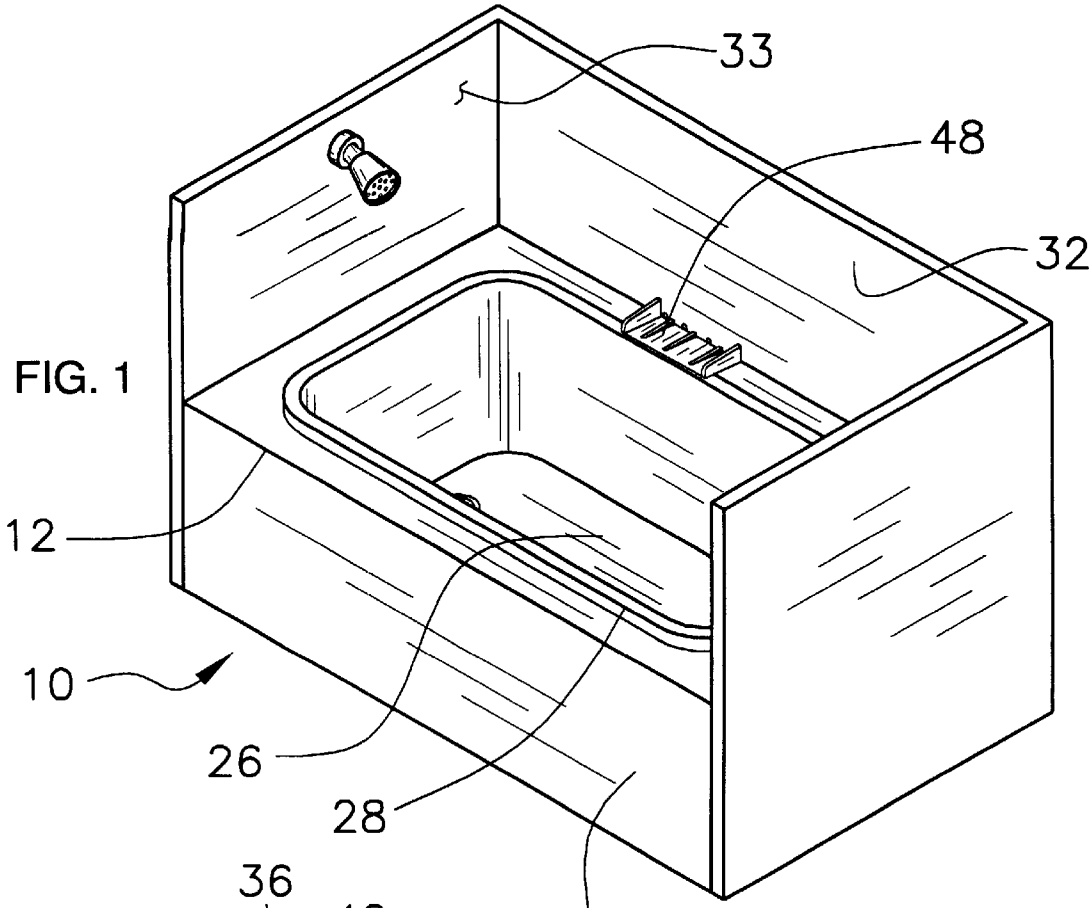
FIG. 1 is a schematic perspective view of a new doll bath according to the present invention.
Figure 2:
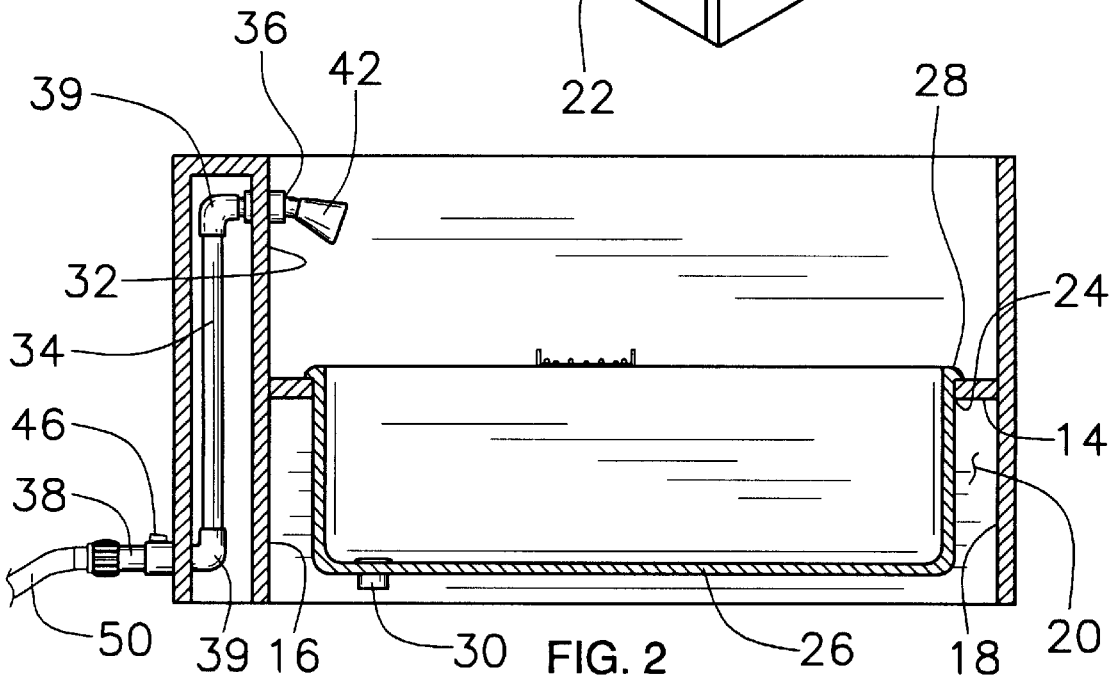
FIG. 2 is a schematic cross-sectional side view of the present invention.
Figure 3:
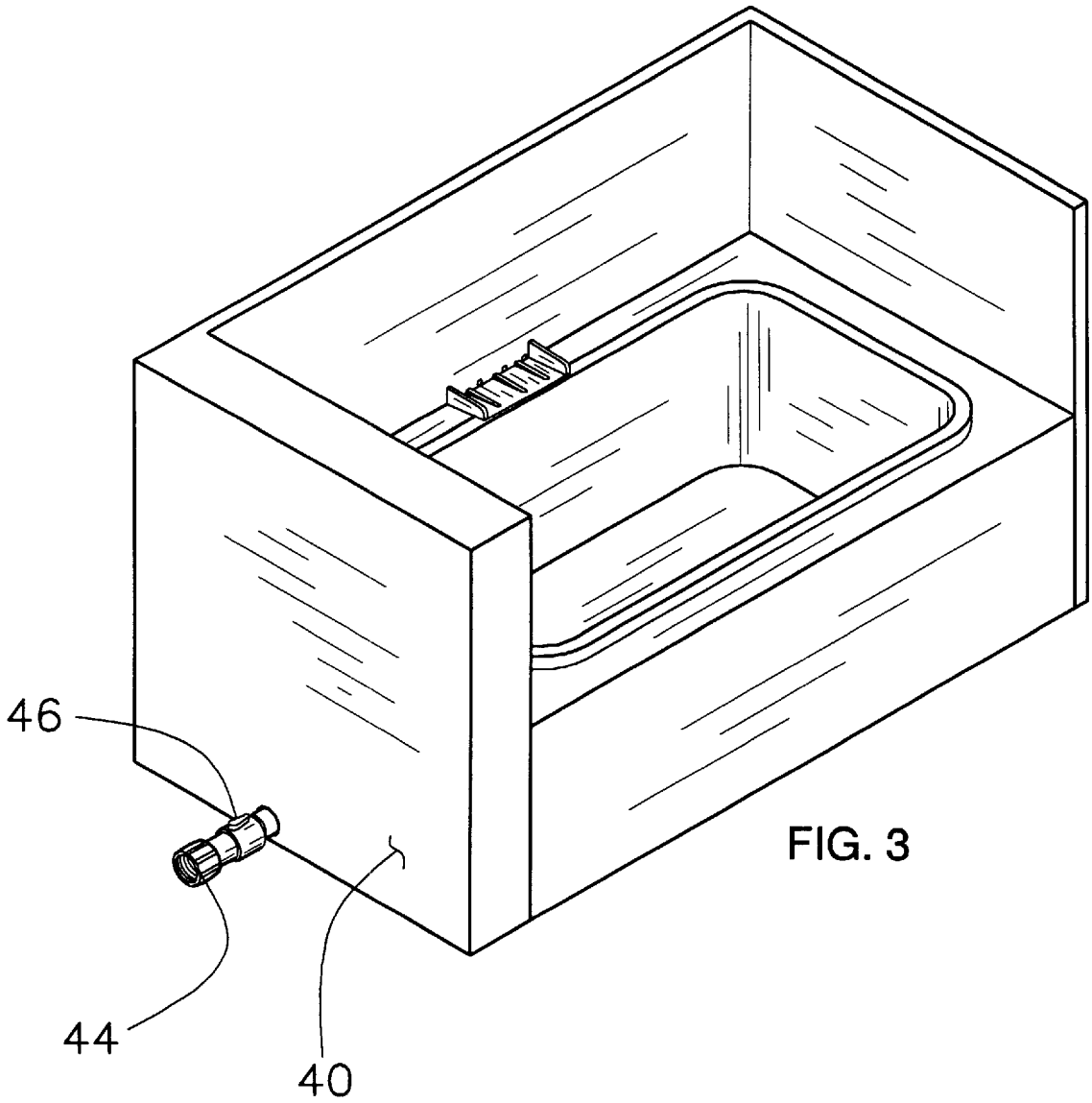
FIG. 3 is a schematic perspective view of the present invention.

With reference now to the drawings, and in particular to FIGS. 1 through 3 thereof, a new doll bath embodying the principles and concepts of the present invention and generally designated by the reference numeral 10 will be described.

As best illustrated in FIGS. 1 through 3, the doll bath 10 generally comprises a housing 12 having a top wall 14, a first side wall 16, a second side wall 18, a third side wall 20, and a fourth side wall 22. The first 16 and second 18 side walls is opposite of each other. The top wall 14 has an opening 24 therein. The first 16 and second 18 side walls have a length preferably between 12 inches and 14 inches. The third 20 and fourth 22 side walls have a length preferably between 23 inches and 25 inches. The side walls each have a height preferably between 4 inches and 6 inches.

A toy bathtub 26 is positioned in the opening. The bathtub 26 has a size substantially equal to the opening 24 in the housing 12. An upper edge of the bathtub has a lip 28 thereon coupled to the top wall 14. The bathtub 26 has a drain opening 30 therein.

A splash guard 32 is attached to the housing 12. The splash guard 32 extends along and upwardly from the first 16, second 18 and third 20 side walls. The splash guard 32 comprises a rigid panel having a height preferably between 5 inches and 7 inches.

A pipe 34 is elongated and has a first end 36 and a second end 38. The pipe 34 has a pair of bends 39 therein. Each of the bends 38 is generally equal to 90 degrees. Each of the bends 39 is located generally adjacent to one of the ends of the pipe 34 such that the ends 36, 38 are directed in opposite directions of each other. The pipe 34 is positioned in the first side wall 16 and the splash guard 32 such that the first end 36 of the pipe 34 extends outwardly through a front side 33 of the splash guard 32 and the second end 38 of the pipe 34 extends outwardly through a back side 40 of the first side wall 16. The first end 36 of the pipe 34 has a nozzle 42 thereon. The second end 38 of the pipe 34 has a threaded hose [44] coupler 44 thereon. The threaded hose coupler 44 permits connection to a garden hose, as clearly shown in FIG. 2. A valve 46 selectively closes or opens the pipe 34 and is positioned adjacent to the second end of the pipe 34, and is coupled to the second end of the pipe (see, e.g., FIG. 2). The valve is positioned external to the housing, as shown in FIGS. 2 and 3.

A soap holder 48 is attached to the top wall 14 and is positioned between the bathtub 26 and the second side wall 20. The soap holder 48 comprises a pair of parallel orientated and spaced plates extending upwardly from said housing.

In use, a water supply hose 50 is coupled to the second end 38 of the pipe 34 and water runs through the pipe 34 to supply a shower-like stream of water into the bathtub 26. The user may then bathe their dolls within the bathtubs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A doll bathing toy comprising:

a housing having a top wall, a first side wall, a second side wall, a third side wall, and a fourth side wall, said first and second side walls being opposite of each other, said top wall having an opening therein, said first and second side walls having a length between 12 inches and 14 inches, said third and fourth side walls having a length between 23 inches and 25 inches, said side walls having a height between 4 inches and 6 inches;

a toy bathtub being positioned in said opening, said bathtub having a size substantially equal to said opening, an upper edge of said bathtub having a lip thereon coupled to said top wall, said bathtub having a drain opening therein;

a splash guard extending along and extending upwardly from said first, second and third side wall, said splash guard comprising a rigid panel having a height between 5 inches and 7 inches;

a pipe being elongated and having a first end and a second end, said pipe having a pair of bends therein each being equal to 90 degrees, each of said bends being located generally adjacent to one of said ends of said pipe such that said ends are directed in opposite directions of each other, said pipe being positioned in said splash guard such that said first end of said pipe extends through front side of said splash guard and said second end of said pipe extends through said back side of said first side wall, said first end of said pipe having a nozzle thereon, said second end of said pipe having a threaded hose coupler thereon, a valve for selectively closing or opening said pipe, said valve being coupled to said second end of said pipe, said valve being positioned external to said housing, said valve having a threaded portion, said threaded portion facilitating connection to a garden hose; and a soap holder being attached to said top wall and being positioned between said bathtub and said third side wall.

* * * * *